US006150993A

United States Patent [19]

Dobrovolny

[11] Patent Number: 6,150,993

[45] Date of Patent: Nov. 21, 2000

[54] ADAPTIVE INDOOR ANTENNA SYSTEM

[75] Inventor: Pierre Dobrovolny, North Riverside, Ill.

[73] Assignee: Zenith Electronics Corporation, Glenview, Ill.

[21] Appl. No.: 09/276,065

[22] Filed: Mar. 25, 1999

[51] Int. Cl.[7] ..... H01Q 21/00

[52] U.S. Cl. ..... 343/853; 343/700 MS

[58] Field of Search ..... 343/700 MS, 853, 343/846; 342/368, 372; H01Q 21/00

[56] References Cited

U.S. PATENT DOCUMENTS

| | | | |
|---|---|---|---|
| 5,038,147 | 8/1991 | Cerro et al. | 342/368 |
| 5,200,756 | 4/1993 | Feller | 343/700 MS |
| 5,734,349 | 3/1998 | Lenormand et al. | 342/373 |

*Primary Examiner*—Don Wong
*Assistant Examiner*—Hoang Nguyen

[57] ABSTRACT

An indoor antenna for a UHF and higher frequency receiver has a plurality of polygon shaped conductive elements spaced apart from each other in a three dimensional arrangement. The signals from each pair of elements are combined through adjustable phase and attenuation networks and the combined signal is supplied to the input of a receiver that includes evaluation circuitry for optimizing the response of the antenna system when subjected to multipath conditions. A plurality of sets of random adjustment values are initially applied to the phase and attenuation networks and the antenna response over the signal band is monitored. The set of random values that exhibits the least deviation from the optimum antenna response over the received frequency band is used as the starting point for an optimization program for the calculation of further adjustments to the individual phase and attenuation networks to optimize the antenna response over the received signal band.

10 Claims, 4 Drawing Sheets

ADAPTIVE INDOOR ANTENNA SYSTEM

BACKGROUND OF THE INVENTION

This invention relates generally to antenna systems and specifically to antenna systems for receiving digital ATV (Advanced television) signals, as recently adopted by the FCC for broadcast communications, that are in and above the UHF frequency range.

The recently approved digital ATV signals have a vestigial sideband (VSB) form and are designed to operate in the vicinity of NTSC cochannel signals with minimal interference. The digital signals will initially be of relatively low power, especially within an indoor environment and, consequently, there is a need for efficient indoor antenna systems, replacing the ubiquitous dipoles and "bowties". In particular, the response of the antenna system should be uniform across the frequency band and adaptable to minimize the effects of multipath signal propagation. Multipath refers to the condition where a transmitted signal is reflected by buildings, objects and the like to create one or more signals that are not coherent with the main signal. Because the VSB signal does not have the redundancy of an NTSC signal, receiving and demodulating systems are more critical due to the "cliff effect". It is therefore of great importance that signal reception be efficient, especially for transmitted signals in the UHF frequency range, where problems of reflection and multipath become paramount.

The present invention provides an adaptive antenna system that is adjustable to optimize signal reception by utilizing the best combination of antenna polarization and directivity. While the described embodiment of the invention is directed to a television environment, it will be appreciated by those skilled in the art that the invention is applicable to any signal receiving system that exhibits similar needs.

OBJECTS OF THE INVENTION

A principal object of the invention is to provide a novel indoor antenna system for digital ATV signals.

Another object of the invention is to provide an adaptive indoor antenna system for improving indoor reception under multipath conditions.

A further object of the invention is to provide an adaptive indoor antenna system that is especially useful in the UHF and higher frequency ranges.

Still another object of the invention is to provide an antenna system that will automatically adjust itself for optimum signal reception.

BRIEF DESCRIPTION OF THE DRAWINGS

These and other objects and advantages of the invention will be apparent upon reading the following description in conjunction with the drawings in which.

DETAILED DESCRIPTION OF THE INVENTION

Figure 1:
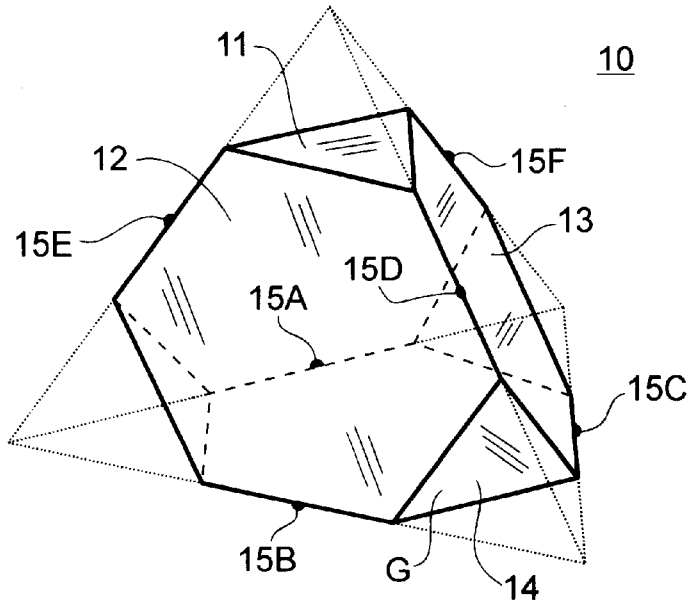
FIG. 1 is a three dimensional view of a simple form of an antenna constructed in accordance with the invention.

Referring to FIG. 1, an antenna 10 has four hexagon-shaped conductive elements or plates 11, 12,13 and 14 arranged in parallel with the sides of a tetrahedron indicated by the dashed extension lines drawn from the plates. The hexagon shape is derived from an equilateral triangle and the tetrahedron is the result of arranging four equilateral triangles to form a three sided (plus a base) pyramid. The plates may conveniently comprise a conductive metal foil affixed to a rigid high quality insulated backing, such as a printed circuit board. The plates are spatially separated, with the bottom plate 14 forming a local ground plane G. Each of the plates has connection pads 15 and 15', with oppositely disposed pairs of the connection pads on the plates forming antenna ports, as will be seen in connection with FIG. 4. The connection pads labelled 15 are on the non-foil side (inner or substrate surface) of the antenna plate and the connection pads labelled 15' are on the foil side of the antenna plates. The six antenna ports, labelled 15A–15F, deliver television signals received by the corresponding plate-pairs of the antenna. Thus, plate-pair 11,14 forms antenna port 15A, plate-pair 12,14 forms antenna port 15B, plate-pair 13,14 forms antenna port 15C, plate-pair 12,13 forms antenna port 15D, plate-pair 11,12 forms antenna port 15E and plate-pair 11,13 forms antenna port 15F.

The size of the plates is determinative of the frequency of reception and the spacing between the plates determines, to some extent, the impedance of the antenna. For the frequencies of interest (UBF band and above), the width of the hexagonal sides is somewhat less than one foot. A gap of about ¼"between adjacent plates yields an impedance approximately compatible with the input impedance of UHF amplifiers. The hexagon shape "opens up" the ends of the antenna to the magnetic component of the transmitted television signal.

Figure 2:
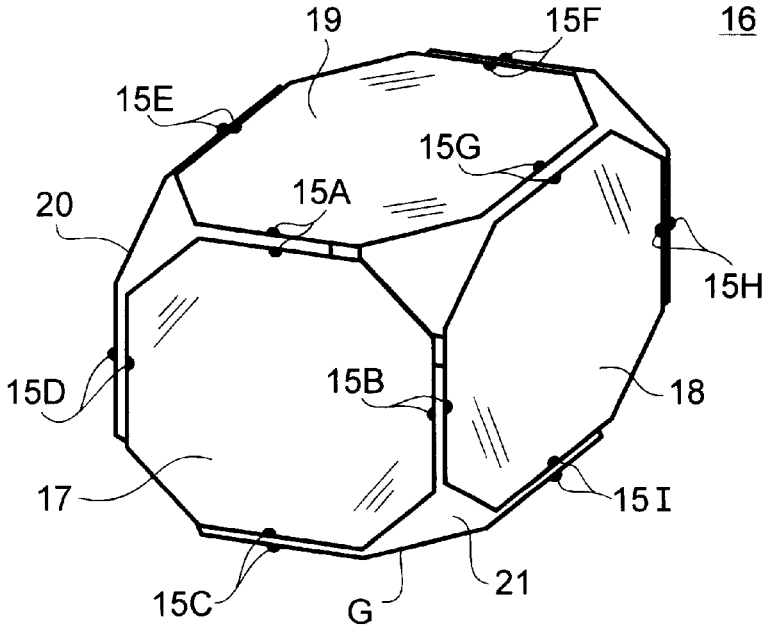
FIG. 2 is a similar three-dimensional view of a more complex form of an antenna constructed in accordance with the invention.

It is recognized that other antenna arrangements may have different geometric shapes, although the tetrahedron shape appears to provide the best compromise between performance and cost. For example, the cube antenna 16 illustrated in FIG. 2 consists of six octagon-shaped plates 17–21 and twelve ports, only eight of which 15A–15I are shown. While the additional plates of the antenna may yield an improved adjustment range, these benefits may not offset the added hardware and software complexity, at least in a consumer electronics environment. Such multifaceted antennas may obviously be of great benefit in other environments where antenna gain and maximum adaptivity are the highest priority considerations.

Figure 3:
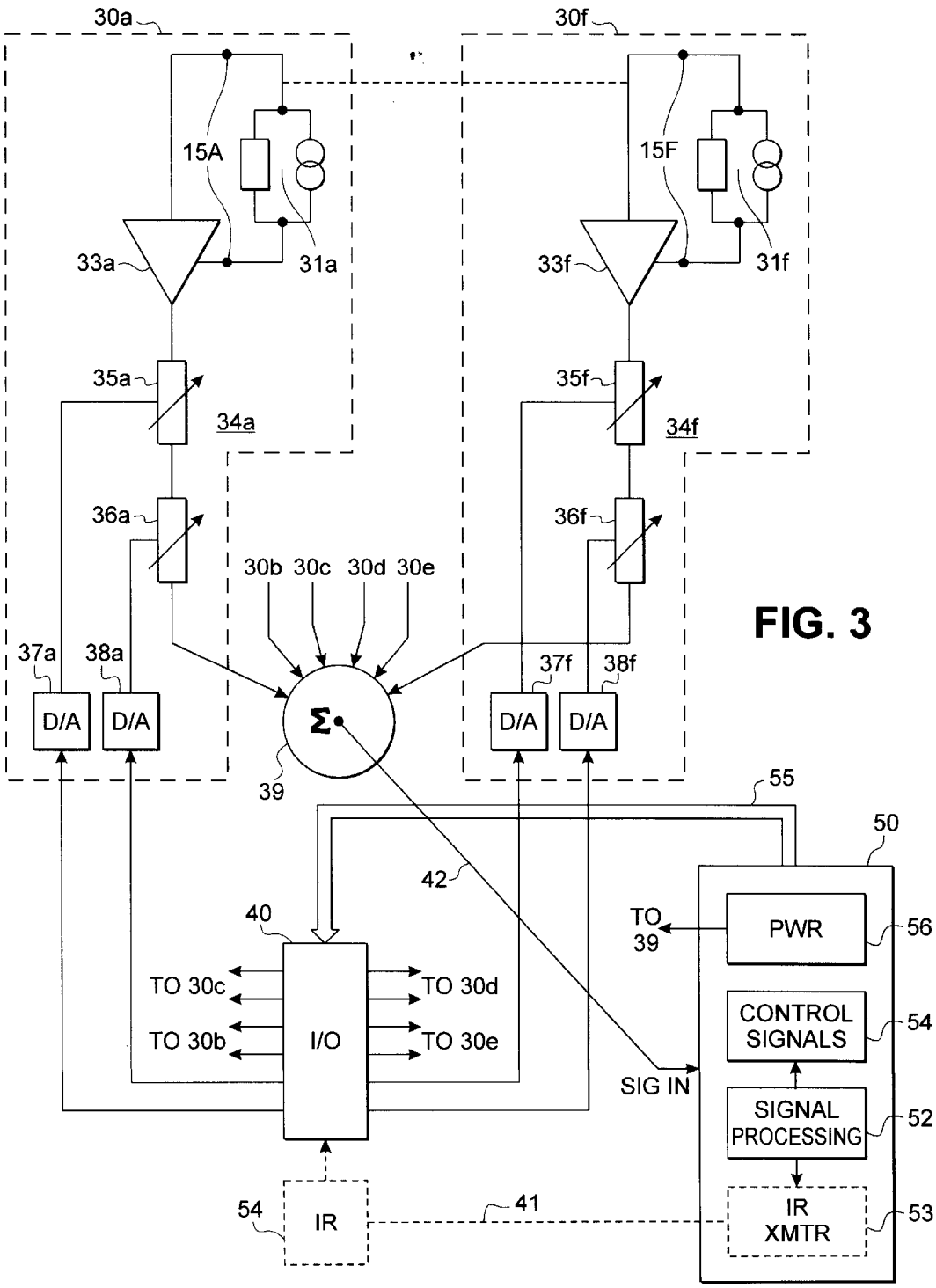
FIG. 3 is a simplified partial schematic diagram of the circuit arrangement of the invention.

The diagram of FIG. 3 shows circuitry 30*a*–30*f* for producing a single multipath corrected antenna signal for a television receiver 50 from the individual signals received from the six antenna ports 15A–15F of antenna 10 of FIG. 1. Dashed lines enclose the elements associated with each antenna port. Circuit 30*a* depicts the partial antenna circuit schematically as a current source 31*a* coupled to an amplifier 33*a*. Amplifier 33*a*, in turn, supplies a signal to an adjustable phase and attenuation network 34*a* that consists of a combination of an adjustable phase shifter 35*a* and an adjustable attenuator 36*a*. The adjustable phase and attenuation network 34*a* supplies its signal to a combiner 39, which as indicated, receives signals, adjusted in magnitude and phase, from each of the other antenna ports via circuits 30*b*–30*f*, combines them into a single signal and supplies that signal over a signal line 42 to television receiver 50. The adjustable phase shifters 35*a*–35*f* and the adjustable attenuators 36*a*–36*f* of the various networks 30*a*–30*f* are changed in value via digital to analog converters (D/A) 37*a*,38*a*–37*f*, 38*f*. The D/As are controlled from an interface circuit I/O 40 that is linked to, and controlled by, television receiver 50. As illustrated, these control signal inputs communicate via a suitable control bus cable 55 that interconnects television receiver 50 and I/O circuit 40. Within television receiver 50 is a signal processing block 52 that is coupled to a control signals block 54 that supplies suitable control signals to I/O 40 over the control bus cable 55. Control bus cable 55 may, for example, comprise a three-wire cable having a clock line, a data line and a ground line for carrying the serial type control signals as voltage pulses on the lines. An alternate control signal coupling arrangement is indicated by the dashed lines interconnecting an IR transmitter 53 that is associated with television receiver 50, with an IR receiver 54 that communicates with I/O 40. In this arrangement, the control signals from the television receiver are sent over an IR link 41. Such an arrangement avoids the need for additional wiring next to cable 55 and routed to the antenna, which minimizes the influence of other conducting bodies on the antenna radiation pattern. A power circuit 56 in the television receiver supplies DC operating voltage to the antenna arrangement of the invention through cable 55. In some environments, it may be desirable to use either a fiber optic or a wireless link, with suitable optical or wireless conversion equipment at each end of the link. Signal processing block 52 includes a microprocessor and computer programs for performing signal error determinations, as will be discussed below, for optimizing the received signal, i. e., minimizing the effects of multipath.

Figure 4A:
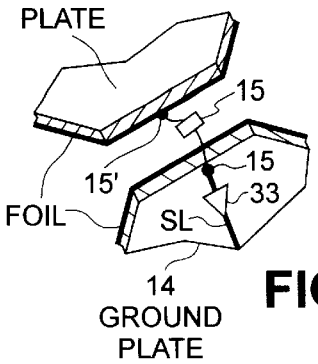
FIG. 4*a* illustrates an antenna signal input connection.
Figure 4B:
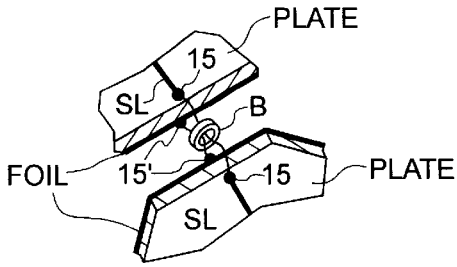
FIG. 4*b* illustrates one form of antenna signal output coupling connection.
Figure 4:
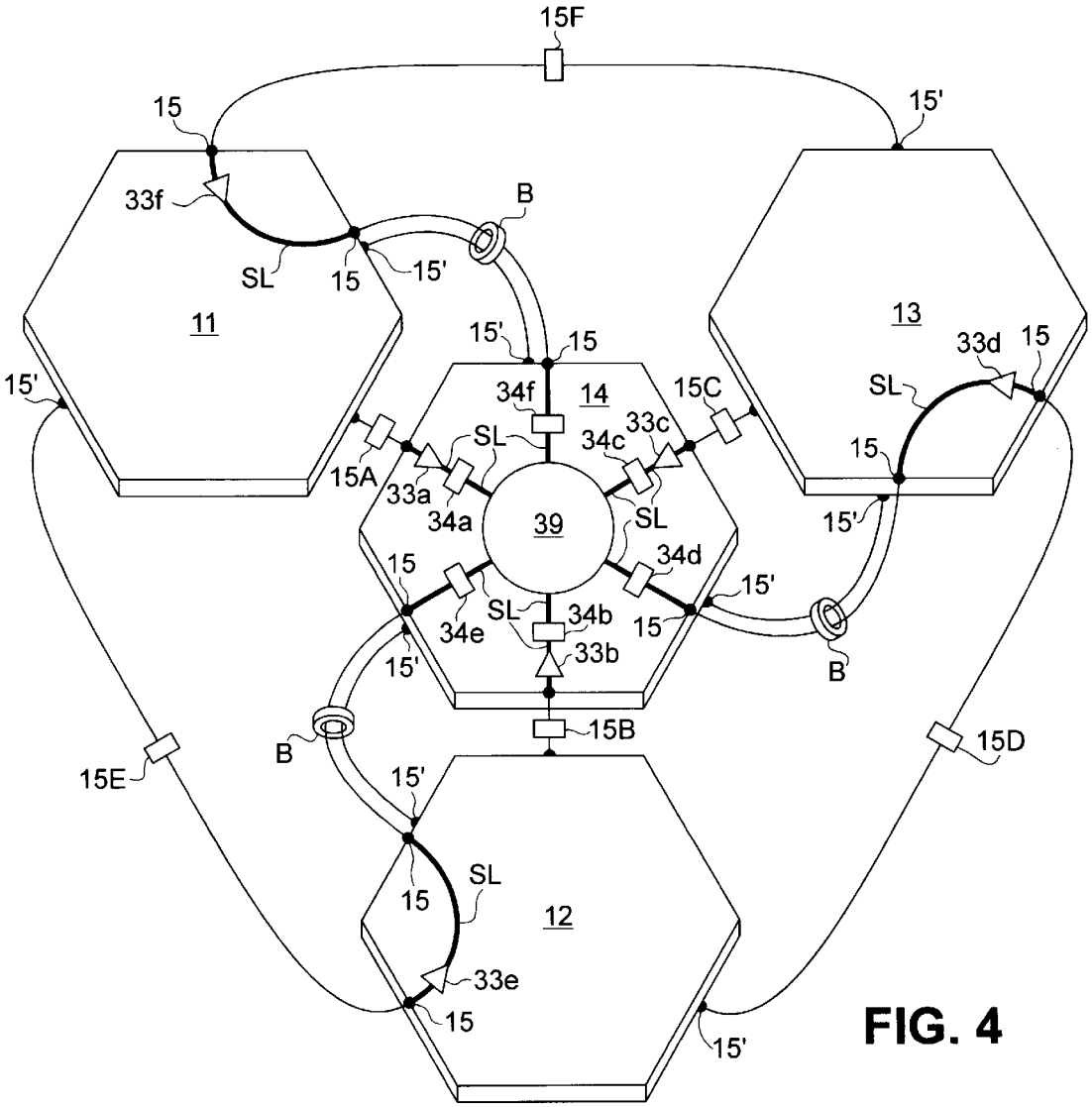
FIG. 4 is an unfolded planar view illustrating the antenna elements and their interconnection in the FIG. 1 form of the invention.

FIG. 4 shows an unfolded planar view of the four hexagon shaped plates 11–14 that comprise the preferred embodiment of antenna 10. The antenna plates are shown in slight perspective to illustrate the connection pads 15 on the inner sides of the plates and the connection pads 15' on the outer or foil sides of the plates. The antenna ports 15A–15F correspond to the antenna signal inputs in FIG. 3. Ideally, the antenna structure is devoid of elements that would interfere with signal reception. However, the need for structural rigidity and the requisite circuitry for processing the antenna signals imposes some limitations on the ideal structure. In the preferred embodiment of the invention, the supporting structure is minimal and the requisite circuitry is formed very close and parallel to the planes of the antenna plates. Therefore, three of the amplifiers (33*a*, 33*b* and 33*c*) and all of the antenuator-phase shift circuits 34*a*–34*f* are preferably formed on the inner substrate of the bottom (ground) plate 14. The three remaining amplifiers (33*d*, 33*e* and 33*f*) are formed on the corresponding inner surfaces of antenna plates 11, 12 and 13, respectively. The inputs of amplifiers 33*a*, 33*b* and 33*c* are connected to antenna ports 15A, 15B and 15C, respectively. The outputs of these amplifiers are connected by microstrip lines (SL) to phase and attenuation networks 34*a*, 34*b* and 34*c*, respectively. On the other hand, the inputs of amplifiers 33*d*, 33*e* and33*f* are connected to antenna ports 15D, 15E and 15F on antenna plates 13, 12 and 11, respectively, whereas the outputs of these amplifiers are connected by SLs and baluns B (having a high common mode impedance), to their corresponding phase and attenuation networks 34*d*, 34*e* and 34*f*, respectively, on antenna plate 14. The amplifiers, adjustable phase and attenuation networks and SLs are formed or deposited on the substrate or inner side of the antenna plates and electrically isolated from the conductive foil of the respective antenna plate, which foil comprises the pickup element of the antenna as well as a ground plane for the aforementioned circuitry. A rigid support structure, (not shown) of non-conductive, low loss molded material, such as plastic, may be used to secure the antenna plates and other elements in fixed relationship to each other. All of the adjustable phase and attenuation networks 34*a*–34*f* are in turn coupled to combiner 39, where a single antenna signal is developed and supplied to television receiver 50. Combiner 39 is also carried on the inner surface of antenna plate 14 and its output is coupled to television receiver 50 via a suitable coaxial cable. (It should be noted that the blocking capacitors and chokes (FIG. 5) for supplying DC to the amplifiers are omitted in FIG. 4 for the sake of clarity.)

FIGS. 4A and 4B illustrate the two types of connections between the antenna plates. In FIG. 4A, an amplifier input port (IN) comprises the connection pad 15 connected to the outer foil side of the plate opposite to the amplifier, and connection pad 15' on ground plate 14. In FIG. 4B, the balun B is connected between the foil sides of the adjacent antenna plates at connection pads 15' and the SLs on the inner sides of the antenna plates at connection pads 15.

Figure 6:
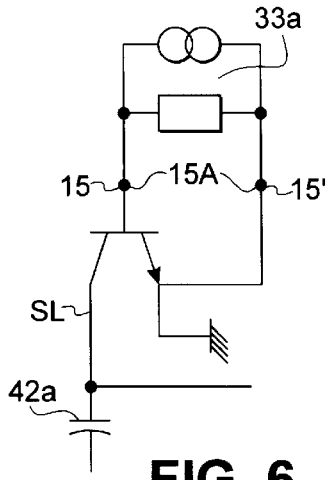
FIG. 6 is a complement to the schematic of FIG. 5, in which the output of the amplifier (on its associated antenna plate) does not include a balun.
Figure 5:
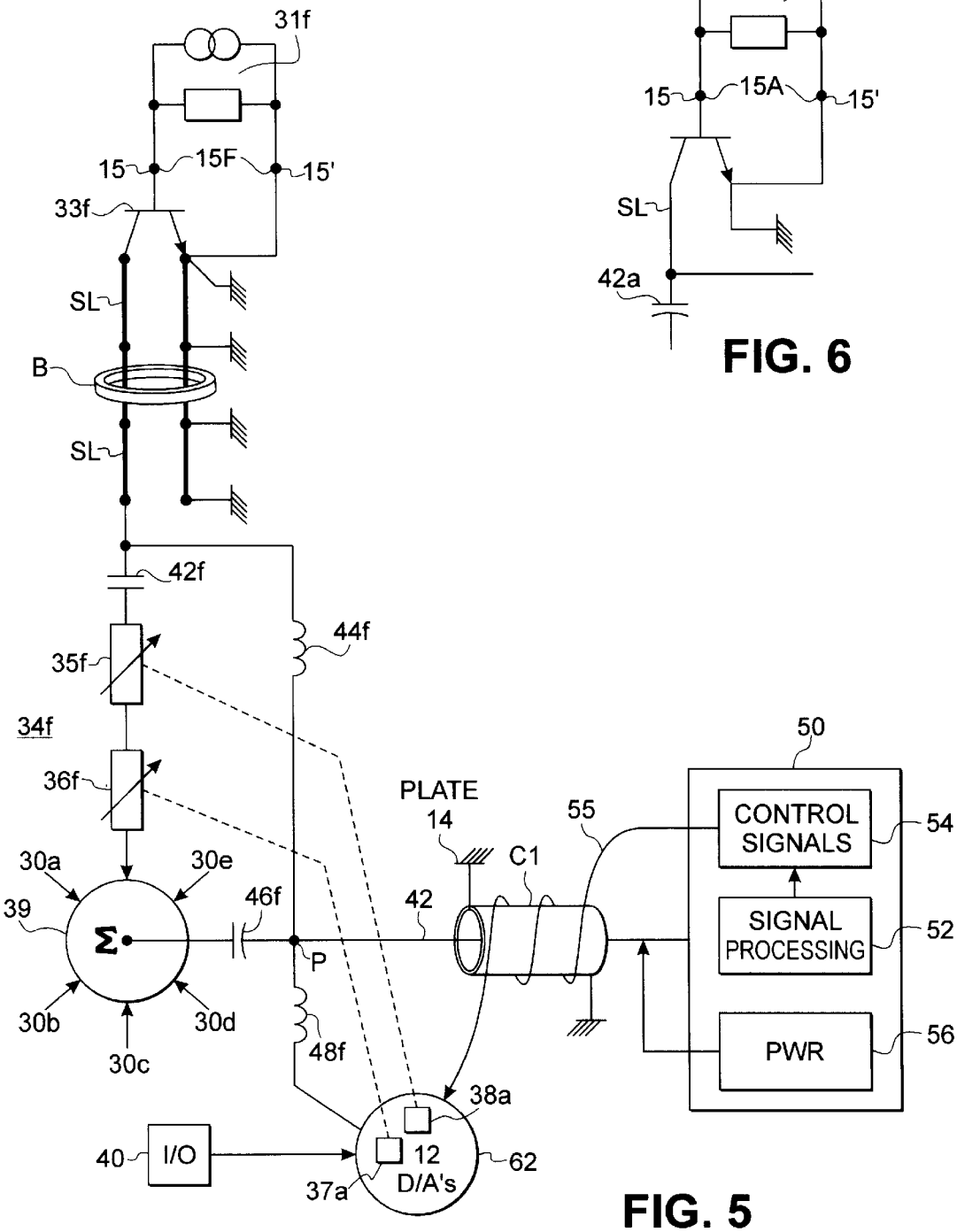
FIG. 5 is a partial schematic diagram of the components of a representative one of the six signal paths that contribute to the combined output of the antenna system in which the output of the amplifier (on its associated antenna plate) includes a balun.

FIG. 5 indicates an advantageous arrangement of the elements of the antenna system. Antenna port 15F is coupled to amplifier 33*f*, which, for simplicity, is shown as a transistor. Obviously the amplifier may take a more complex form, if desired. The amplifier output is coupled via SLs and balun B to a DC blocking capacitor 42*f* that is interposed in the signal path to adjustable phase element 34*f*. DC power is supplied to amplifier 33*f* from power source 56 in television receiver 50 over signal line 42 to a junction P. A choke 44*f* connects junction P to blocking capacitor 42*f*. Similarly, DC power is supplied to the twelve D/As, which are preferably on one or more integrated circuit chips 62. The DC on the signal line 42 is isolated from combiner 39 by another blocking capacitor 46*f*. The signal line 42 is the center conductor of a coaxial cable C1 that is connected between television receiver 50 and plate 14. The control cable 55 may conveniently be wrapped around coaxial cable C1 and coupled to the integrated circuit chip 62. It will be appreciated that the circuit for only the amplifier input corresponding to antenna port 15F of the antenna arrangement is shown, it being understood that the amplifier input connections for the antenna ports 15D and 15E have identical circuits. The circuits for the amplifier inputs corresponding to antenna ports 15A, 15B and 15C differ only slightly in the absence of a balun, as is illustrated in FIG. 6. In all other respects, the amplifier input circuit connections are identical.

The mechanism of control of the adjustable phase and attenuation networks may comprise a signal or other factor derived from the television receiver that yields an indication of optimized signal reception. For example, a system having a channelized narrow band amplifier for the IF signal derived from a received television channel (44 MHz+/−3 MHz) may be used, with the average signal strength at each of the group of discrete frequencies being recorded and processed to determine the deviations from a flat uniform response, indicating the degree of multipath suppression. After each adjustment of the adjustable phase and attenuation networks, the IF signal is interrogated and new signal strength readings are recorded. The process is continued for a predetermined time or until the deviation in response across the IF signal is brought to within predetermined limits. Another approach is to use an equalizer in the television receiver since, in the absence of ghosts caused by multipath conditions, the equalizer taps will indicate the generation of minimum signal correction energy. Hardware and software for performing such operations is indicated by processing block 52 and control signal block 54 in television receiver 50 which develop suitable control signals for effecting changes in the settings or values of the adjustable phase and attenuation networks.

In the operation of the adaptive antenna system of the invention, a software-based error function is defined to establish how good the response of the antenna is. The error function could be, for example, the sum of the squares of the deviations from desired response shape divided by the number of sample channels. Use of the squares of the deviations eliminates the difficulty associated with the summing of positive and negative deviations. Such an approach is well known and is very feasible with the power and speed of computers, such as the microprocessor that resides in signal processing block 52. In accordance with the invention, the error function is used to establish a starting point for the parameters of the adjustable phase and attenuation networks. Therefore, upon initial signal locking, a set of random phase and attenuation network adjustment values is applied to all adjustable phase and attenuation networks and the results analyzed. In the case of a channelized amplifier, the strength of the IF signal at the various channel frequencies is recorded. In the case of an equalizer, the signal correction energy developed by the equalizer is noted. Additional sets of random adjustment values are applied to the adjustable phase and attenuation networks and the corresponding resultant channelized IF signal strengths or equalizer-developed signal correction energies are noted for each set.

Upon completion of a number of such random value applications, the set of random values that resulted in the most uniform signal strength across the IF signal channel or the lowest signal correction energy from the equalizer is selected as the beginning point for further individual parameter adjustments of the adjustable phase and attenuator networks. The further adjustments are made by perturbing one parameter at a time and analyzing the result with the error function until optimum antenna reception is achieved. In its basic form, the error function method is incorporated within sophisticated techniques, such as the Gradient Method or Simplex Method, etc.

What has been described is a novel indoor antenna that may be adapted for optimal signal reception in its environment. It is recognized that numerous changes to the described embodiment of the invention will be apparent without departing from its true spirit and scope. The invention is to be limited only as defined in the claims.

What is claimed is:

1. A method of operating a three dimensional indoor receiver antenna system, comprising:

providing an antenna, having at least four spatially separated conductive elements of a size selected for operation at UHF and higher frequencies, coupled to a receiver;

providing individual adjustable phase and attenuation networks for adjacent pairs of the separated conductive elements of the antenna system;

receiving a transmitted signal with the spatially separated conductive elements; and adjusting the individual phase and attenuation networks to optimize the signal supplied to the receiver with respect to multipath.

2. The method of claim 1, further comprising:

applying a plurality of sets of random phase and attenuation values to the individual phase and attenuation networks; and selecting, for further adjustment, the set of random values that results in the most nearly optimum signal supplied to the receiver.

3. The method of claim 2, further comprising:

combining the signals from the adjacent pairs of the conductive elements to form a resultant signal;

applying the resultant signal to the receiver; and determining from the resultant signal the values for the individual phase and attenuation networks.

4. A three dimensional indoor antenna system for a receiver comprising:

at least four spatially separated conductive elements of a size selected for operation at UHF and higher frequencies;

a plurality of individual adjustable phase and attenuation networks coupled to adjacent pairs of said conductive elements;

a receiver for receiving a signal from said conductive elements;

signal processing means for producing an indication of the response of said antenna system to the received signal; and means for adjusting said plurality of individual adjustable phase and attenuation networks as a function of the received signal to optimize the signal response of the antenna system with respect to multipath.

5. The system of claim 4, wherein said received signal is developed by combining said signals from said adjacent pairs of said separate conductive elements; and wherein said signal processing means monitors said antenna response over the bandwidth of said received signal.

6. The system of claim 5, further including:

means for applying a plurality of sets of random phase and attenuation values to said individual adjustable phase and attenuation networks; and means for selecting for adjustment the set of random values that results in the least degradation in said antenna response over the bandwidth of said received signal.

7. The system of claim 6, wherein there are four spatial elements arranged in the form of a tetrahedron.

8. The system of claim 7, wherein each of said four spatial elements is hexagon shaped.

9. The system of claim 6, wherein each of said spatial elements has a similar geometric shape and further including:

a ground plane formed by one of said spatial elements.

10. The system of claim 9 wherein said conductive elements comprise foil-clad substrates and wherein said individual phase and attenuation networks are formed on the substrate side of said foil clad substrates.

* * * * *